US005369385A

United States Patent [19]

Schulte et al.

[11] Patent Number: 5,369,385

[45] Date of Patent: Nov. 29, 1994

[54] ELECTRICAL SWITCH WITH CURRENT MONITORING

[75] Inventors: Siegfried Schulte, Lüdenscheid; Manfred Aulmann, Schalksmühle, both of Germany

[73] Assignee: Schulte-Elektrotechnik GmbH & Co. KG, Ludenscheid, Germany

[21] Appl. No.: 124,721

[22] Filed: Sep. 21, 1993

[30] Foreign Application Priority Data

Oct. 8, 1992 [DE] Germany ..... 4233918

[51] Int. Cl.[5] ..... H01H 3/00

[52] U.S. Cl. ..... 335/191; 335/167

[58] Field of Search ..... 335/35, 167–176, 335/185–190, 191, 192, 194

[56] References Cited

U.S. PATENT DOCUMENTS 4,516,098 5/1985 Krasser et al. ..... 335/35

4,623,861 11/1986 Krasij et al. ..... 335/186

*Primary Examiner*—Lincoln Donovan

*Attorney, Agent, or Firm*—Edwin D. Schindler

[57] ABSTRACT

An electrical switch having a transmission linkage which is actuated by a rocker and which is coupled to a slide bearing contacts and which contains a triggering lever cooperating with a latching piece. The technical problem is to provide a switch with a strong latching force and reliable unlatching. The transmission linkage is constructed as a toggle lever, to the toggle joint (13) of which the rocker (14) is coupled and the first lever (12) of which is coupled in a bearing which is fixed to the housing and the second lever (11) of which is constructed as a latching lever for a pivot lever (10), which latching lever is active in a position of the toggle lever above the dead center. The pivot lever (10) engages into the slide (6). A yoke lever (15) is constructed as a triggering lever for the second lever (11) of the toggle lever and as a counterbearing for a pressure spring (26). The latching piece latches the yoke lever mechanically or electromagnetically, and the pressure spring (26) on the one hand pre-tensions in the switched-off position the slide (6) and the pivot lever (10) coupled thereto and on the other hand supplies the tensioning force for the yoke lever (15) to trigger the switch.

10 Claims, 7 Drawing Sheets

ELECTRICAL SWITCH WITH CURRENT MONITORING

BACKGROUND OF THE INVENTION

The invention relates to an electrical switch, having a transmission linkage which is actuated by a rocker and which is coupled to a slide bearing contacts and which contains a triggering lever cooperating with a latching piece.

SUMMARY OF THE INVENTION

The object of the invention is the provision of a switch with high latching force and reliable unlatching.

According to the invention, this object is achieved in that the transmission mechanism is constructed as a toggle lever, to the toggle joint of which the rocker is coupled and the first lever of which is coupled in a bearing which is fixed to the housing and the second lever of which is constructed as a latching lever for a pivot lever, which latching lever is active in a position of the toggle lever above the dead centre, in that the pivot lever engages into the slide, in that a yoke lever is constructed as a triggering lever for the second lever of the toggle lever and as a counterbearing for a pressure spring, in that the latching piece latches the yoke lever mechanically or electromagnetically, and in that the pressure spring on the one hand pre-tensions in the switched-off position the slide and the pivot lever coupled thereto and on the other hand supplies the tensioning force for the yoke lever to trigger the switch.

The invention is distinguished from the prior art in that a spring is used both to trigger and also to separate contact. The yoke lever is held in the switched-on position mechanically during the switching-on procedure until latching is activated.

An electromagnetic latching is achieved in that the yoke lever comprises an armature for an electromagnet. During the switching-on procedure, the ready state of the electronic monitoring circuit is achieved. The function of firmly holding the yoke lever is then taken on by the electromagnet.

Overload protection is achieved in that the pivotal latching piece cooperates with a thermal bimetallic triggering element.

Rapid triggering is achieved in that the pivotal latching piece cooperates with a magnetic rapid triggering element.

Undervoltage triggering is also possible without further measures in that the pivotal latching piece cooperates with an undervoltage triggering element.

Uncanted guidance of the levers is achieved in that the pivot lever has two arms between which the yoke lever and the lever of the toggle lever are guided.

Securing of the yoke lever during the switching-on procedure is achieved in that a profiled attachment piece of the first lever of the toggle joint is in engagement with a profiled attachment piece of the yoke lever.

Reliable closure of the magnetic circuit is achieved in that each profiled attachment piece has a circular profiled section and a cam.

Pre-mating contact for the electronic circuit during the switching-on procedure is ensured in that the pivot lever bears a contact bridge which has limited movability and which cooperates with contacts of the conductor plate.

Reliable triggering is ensured in that the yoke lever cooperates with an attachment piece of the second lever of the toggle joint.

BRIEF DESCRIPTION OF THE DRAWINGS

Embodiments of the invention will be described below with reference to the drawings, in which.

DESCRIPTION OF THE PREFERRED EMBODIMENT

Figure 1:
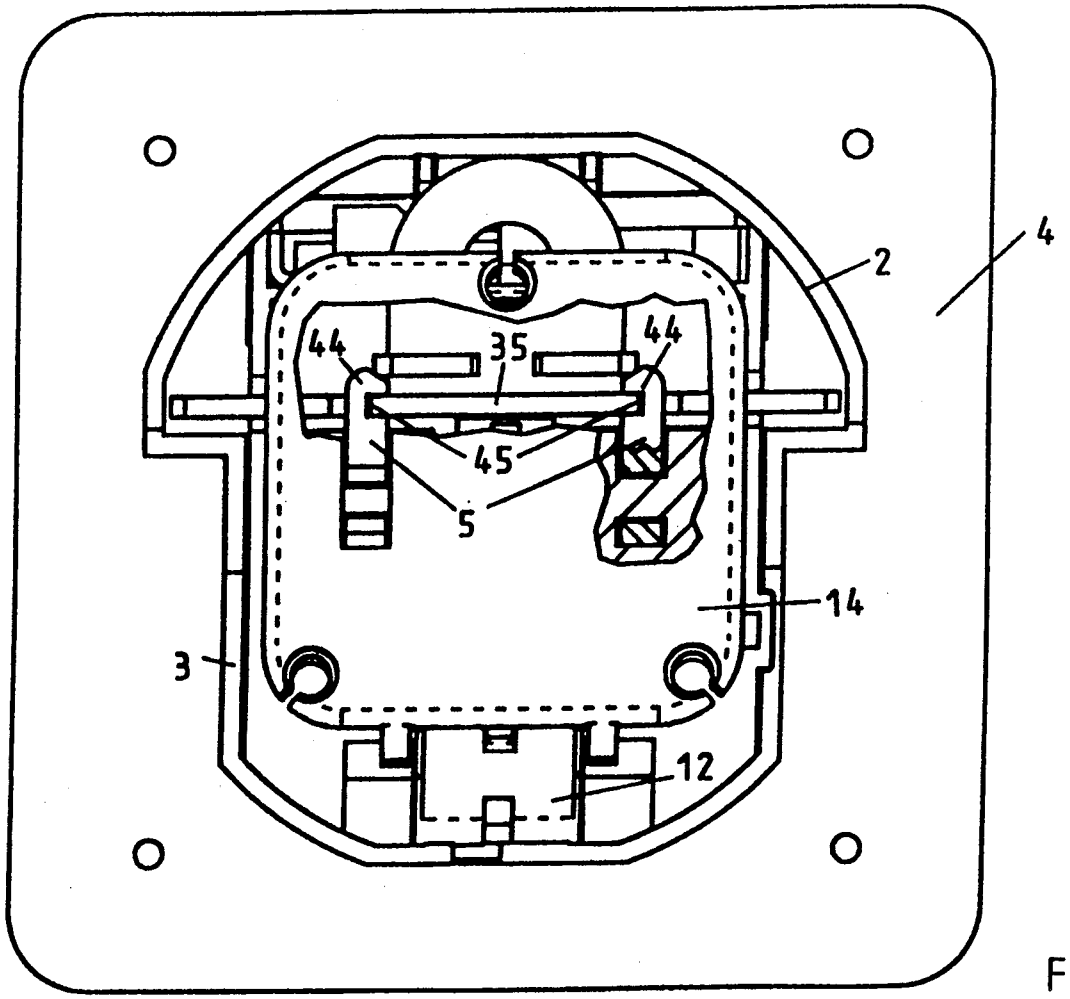
FIG. 1 shows the switch in an installation frame.

A housing 1 having the switch is received in a receiving chamber 2 of an installation frame 3 with a bearing ring 4. Latching lugs 47 serve for locking purposes. The housing 1 has side walls 5 in which the functional parts of the switch are mounted and/or guided. The parts of the switch are assembled in the housing 1. The switch is inserted as a pre-assembled constructional unit into the receiving chamber 2.

The essential functional parts of the switch are a slide 6 having contacts 7 which are opposite fixed contacts 8. The slide 6 is coupled to an arm 9 of a pivot lever 10. Engaging into the pivot lever 10 is a second lever 11 of a toggle lever, the first lever 12 of which is mounted fixed to the housing. The toggle joint 3 connecting the two levers 11 and 12 is coupled to the rocker 14 which in turn is mounted fixed to the housing. Moreover, a yoke lever 15 which bears the armature 16 of an electromagnet 17 acting as a latching piece is provided as a triggering lever.

The housing 1 receives the electromagnet 17 in guides 18. The electromagnet 17 lies in non-displaceable and uncanted manner in the guides of the housing 1.

The yoke lever 15 is mounted on one side in the side walls 5 by means of pins 19. The armature 16 is seated at the other end of the yoke lever 15. The yoke lever 15 bears a profiled attachment piece 20 having a circular profiled section 22 aligned substantially concentrically with respect to the axis 21 of the first lever 12 of the toggle lever and having an adjoining cam section 23. The yoke lever 15 receives on an attachment piece 24 a helical pressure spring 26 which is supported on the other hand on a receiver 25 of the slide 6. This helical pressure spring 26 effects both the triggering as well as contact separation or switching off. In the triggering state, the yoke lever 15 comes to bear against a stop 46 of the pivot lever 10.

The slide 6 bears three contacts 7 for a three-pole circuit. Details of the contacts are not illustrated. Engaging into a window 27 of the slide 6 is the arm 9 of the pivot lever 10. The window 27 and the arm 9 can each be provided in pairs. The pivot lever 10 has an aperture 28 having a locking lug 29 with which a latching lug 30 of the second lever 11, acting as a latching lever, of the toggle lever cooperates. The second lever 11 also has an attachment piece 31 with which the yoke lever 15 cooperates during the triggering procedure, which will be described in more detail below.

Seated on the first lever 12 is a profiled attachment piece 32 having a circular profiled section 33 running concentrically with respect to the axis 21 and having an adjoining cam 34. The profiled attachment piece 32 cooperates with the profiled attachment piece 20 of the yoke lever 15.

A conductor plate 35 receives electrical components and a transformer 36 for current measurement, in particular fault current measurement. Arranged on the conductor plate are two contacts 37 with which a U-shaped contact bridge 38 cooperates. The legs 40 of the contact bridge 38 are guided in arcuate guides 41 in the end part of the pivot lever 10 to be displaceable in the pivotal direction thereof and are pre-tensioned by means of a spring 39. Lugs 43 of the legs come to bear against stops 42 of the arcuate guides 41.

The side walls 5 engage by means of hook attachment pieces 44 in slots 45 of the conductor plate 35. As a result, stabilization of the arrangement is achieved.

The parts of the switch can be arranged in the housing 1 by pushing in, plugging in and pressing in. Securing and holding is effected by means of stops and latches. The housing 1 having the conductor plate 35 is pushed into the receiving chamber 2 of the installation frame 3 and fixed by means of the latching lugs 47. The switch is thus ready for installation or ready for connection. It can be inserted in an installation box or a device housing.

Figure 2:
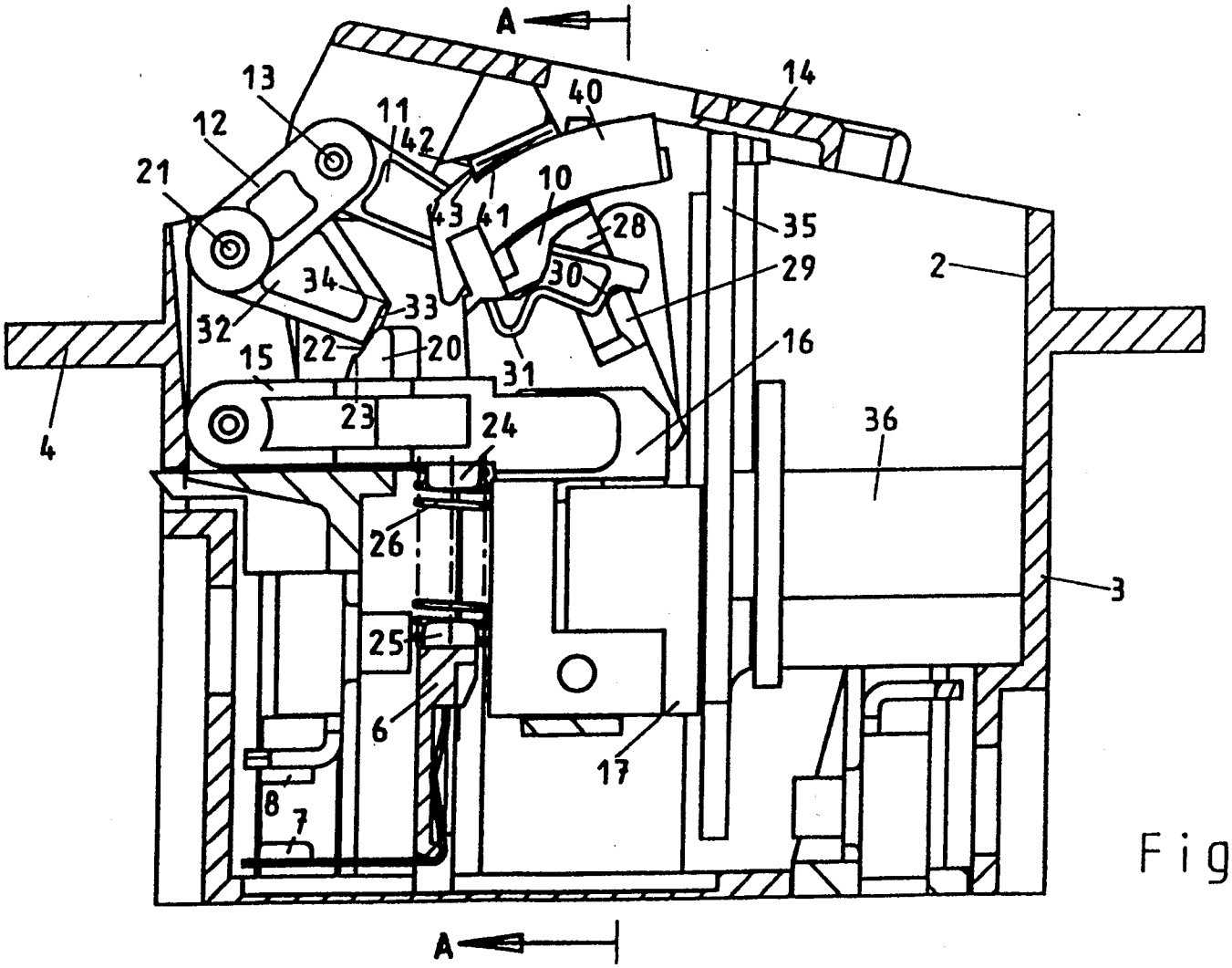
FIG. 2 shows a schematic section through a switch in the switched-off position.
Figure 3:
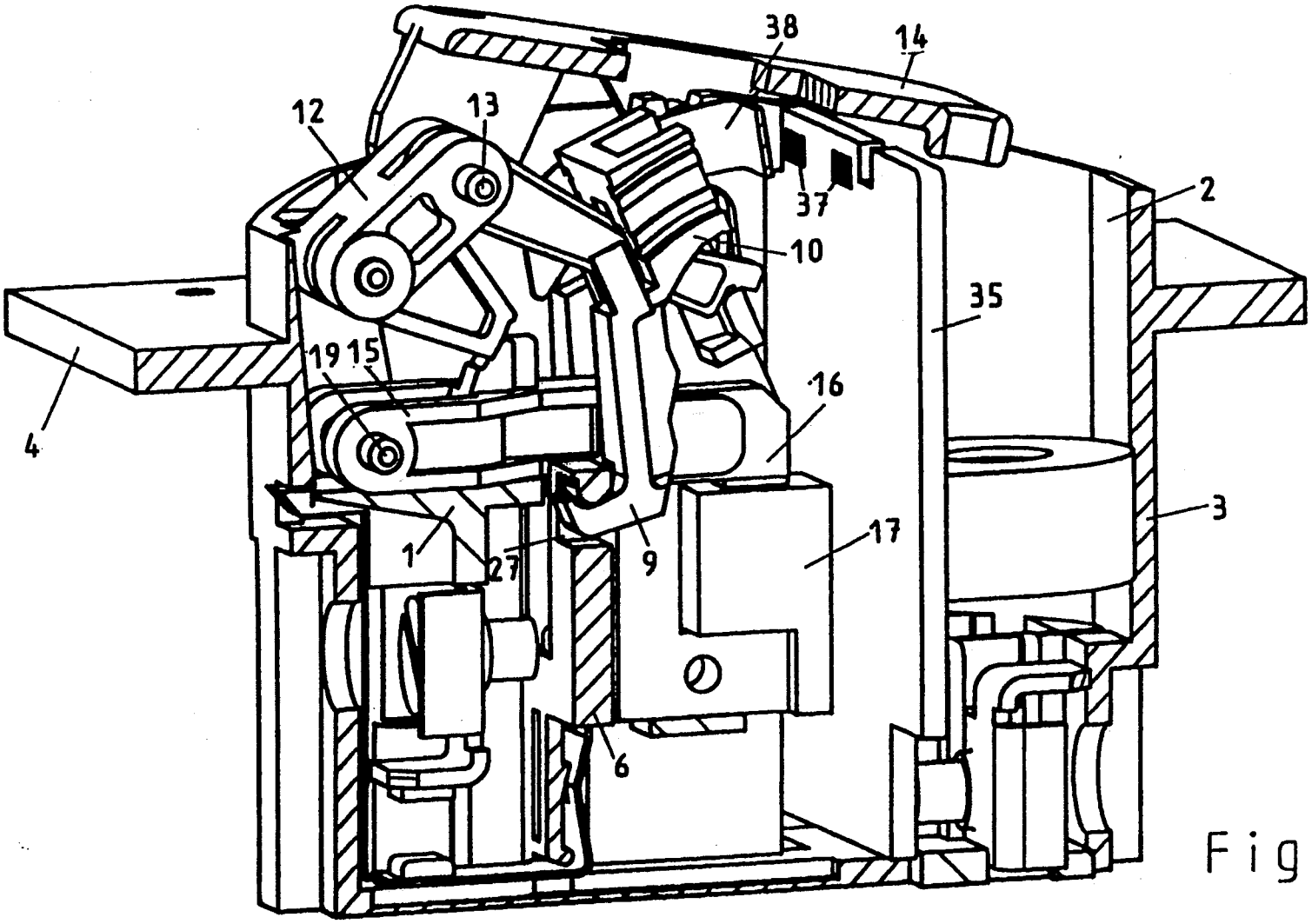
FIG. 3 shows a perspective illustration corresponding to FIG. 2.
Figure 4:
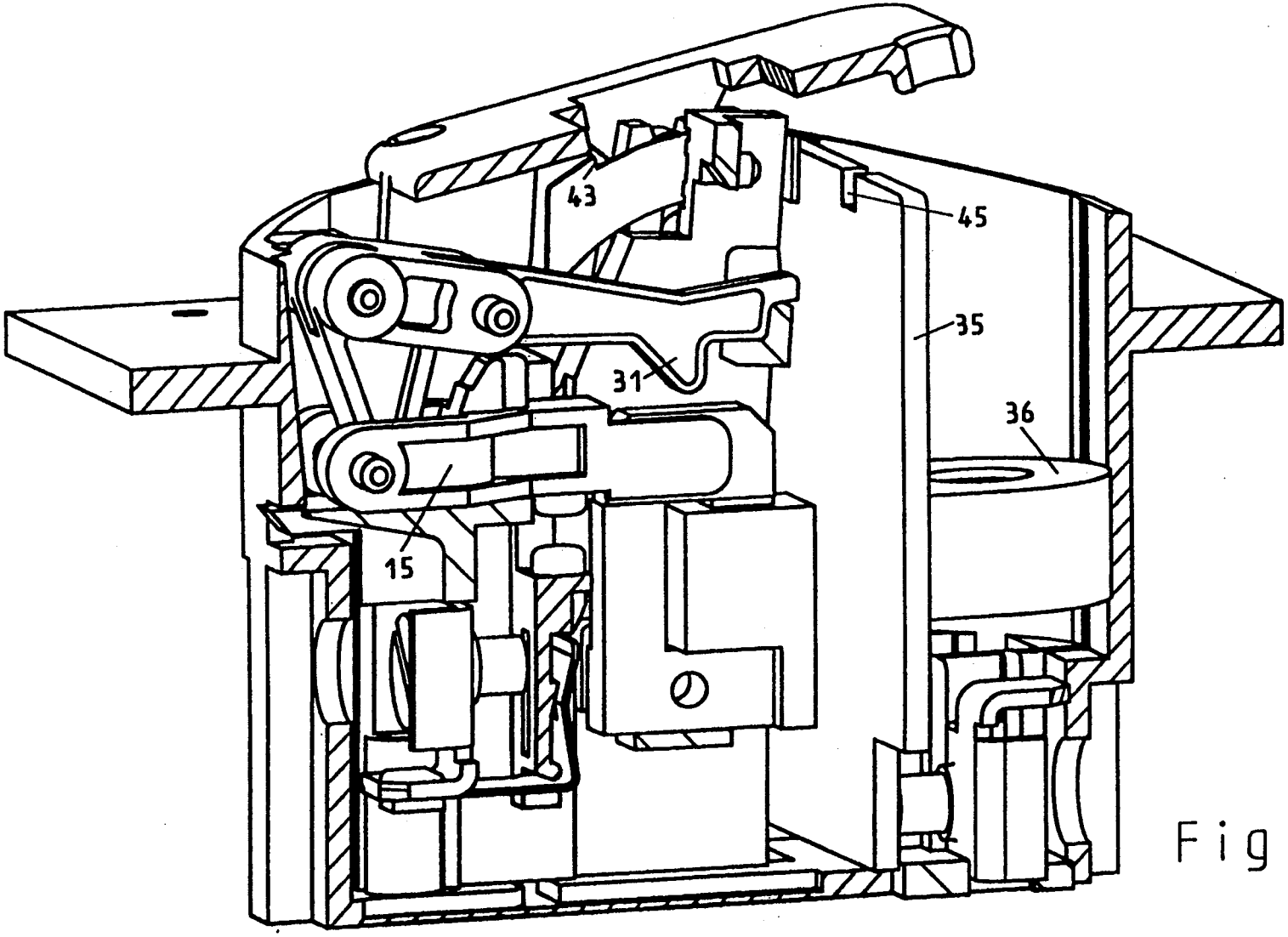
FIG. 4 shows a perspective illustration of the switched-on position.
Figure 5:
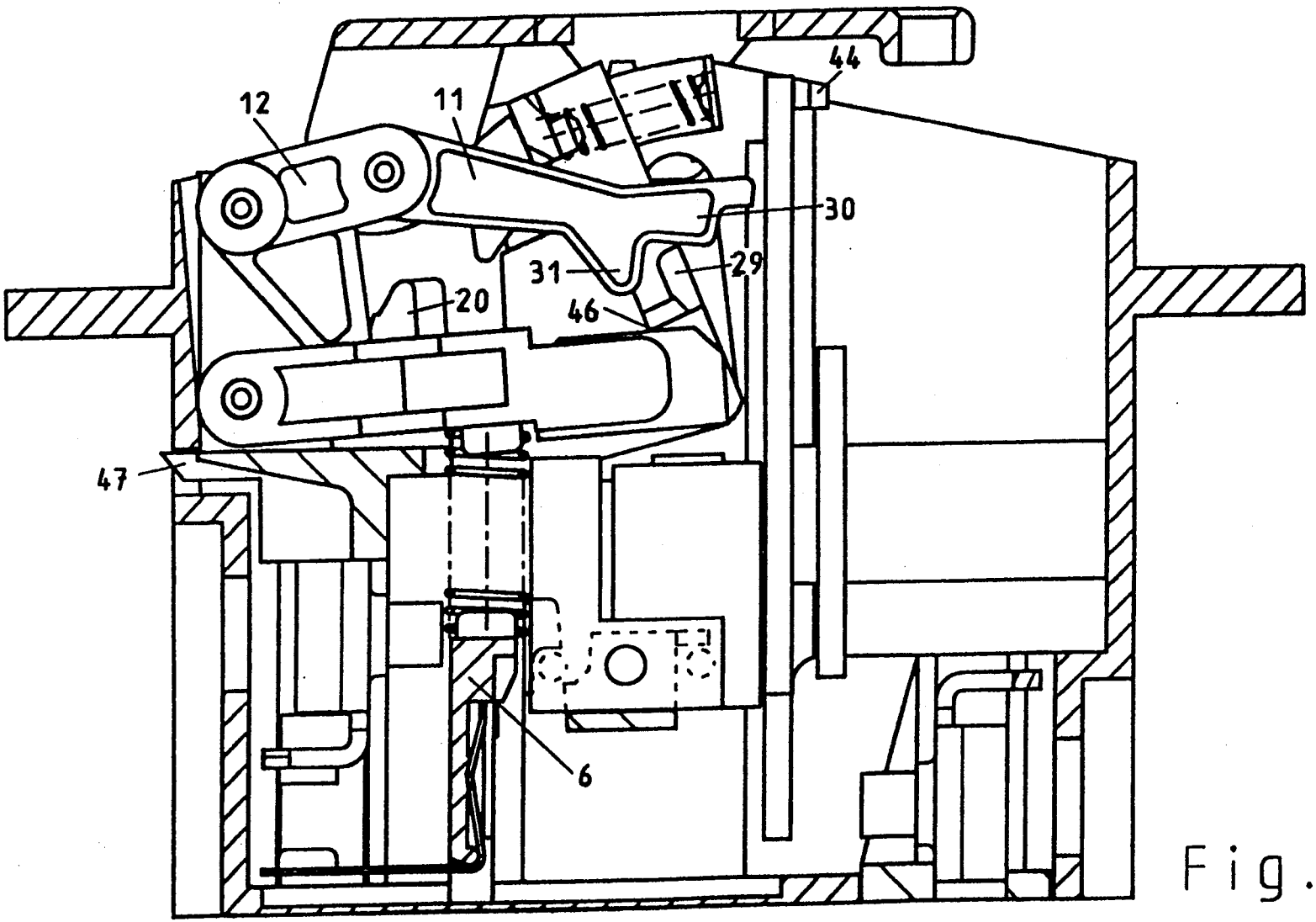
FIG. 5 shows a section illustration of the triggering position.
Figure 6:
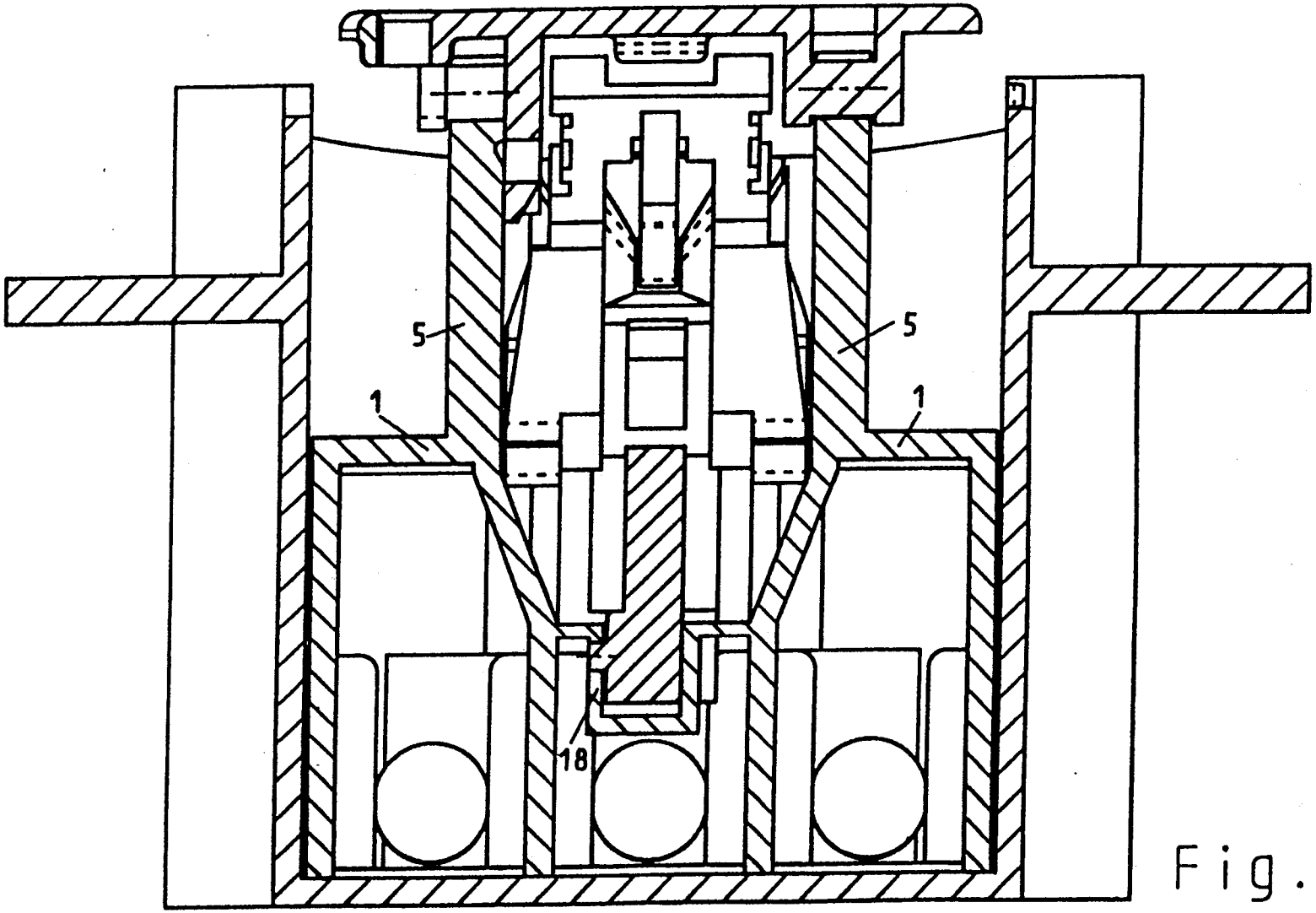
FIG. 6 shows a section along the line A—A in FIG. 2.

FIGS. 1 and 2 show the switched-off position. The yoke lever 15 is held by means of the circular profiled sections 22 and 33 in the position illustrated, where the armature 16 is located at a small spacing from the pole faces of the electromagnet 17. The latching lug 30 of the lever 11 bears against the locking lug 29. The rocker 14 is in the OFF position. The contact bridge 38 is raised from the contacts 37, since the lugs 43 are bearing against the stops 42. As a result, the conductor plate 35 is switched off.

During the switching-on procedure, the rocker 14 is pivoted in the anti-clockwise direction in relation to FIGS. 1 and 2. Here, the toggle joint is straightened. The pivot lever 10 is pivoted in the clockwise direction. After only a very small pivoting distance, the contact bridge 38 comes into engagement with the contacts 37, so that a current circuit for energizing the circuits on the conductor plate 35 is closed. The circuits become ready for operation. The switching-on time is invariably smaller than the switching time of the rocker, so that the ready state is reliably achieved. During the further switching-on movement, on the one hand the slide 6 is raised by means of the arms 9, so that the contacts 7 and 8 close and the spring 26 is tensioned. On the other hand, the yoke lever 15 is held down under the action of the circular profiled sections 22 and 33. In the meantime, the electromagnet receives current by way of the electronic circuit. The cams 23 and 34 press the yoke lever 15 against the electromagnet 17, so that the armature 16 is securely attracted and the yoke lever 15 is latched. The switch is latched in the switched-on state by means of the electromagnet 17. The electronic circuit continuously monitors the current, in particular the fault current.

In the case of an error state, a triggering signal is given. To effect triggering, the electromagnet 17 becomes de-energized. The yoke lever 15 is raised under the action of the spring 26 or pivoted in the anticlockwise direction, so that the yoke lever 15 abuts against the attachment piece 31 and raises the lever 11. The stop 467 limits the movement of the yoke lever 15. The latching lug 30 is raised out of the locking lug 29. The spring 26 presses the slide 6 downwards and thus separates the contacts. Here, the pivot lever 10 is entrained in the anticlockwise direction. The contact bridge 38 is raised from the contacts 37, so that the electronic circuit becomes de-energized.

Switching on again is not possible in this triggering position. The switch must first be brought into the switched-off position. Only then is renewed switching on possible.

Figure 7:
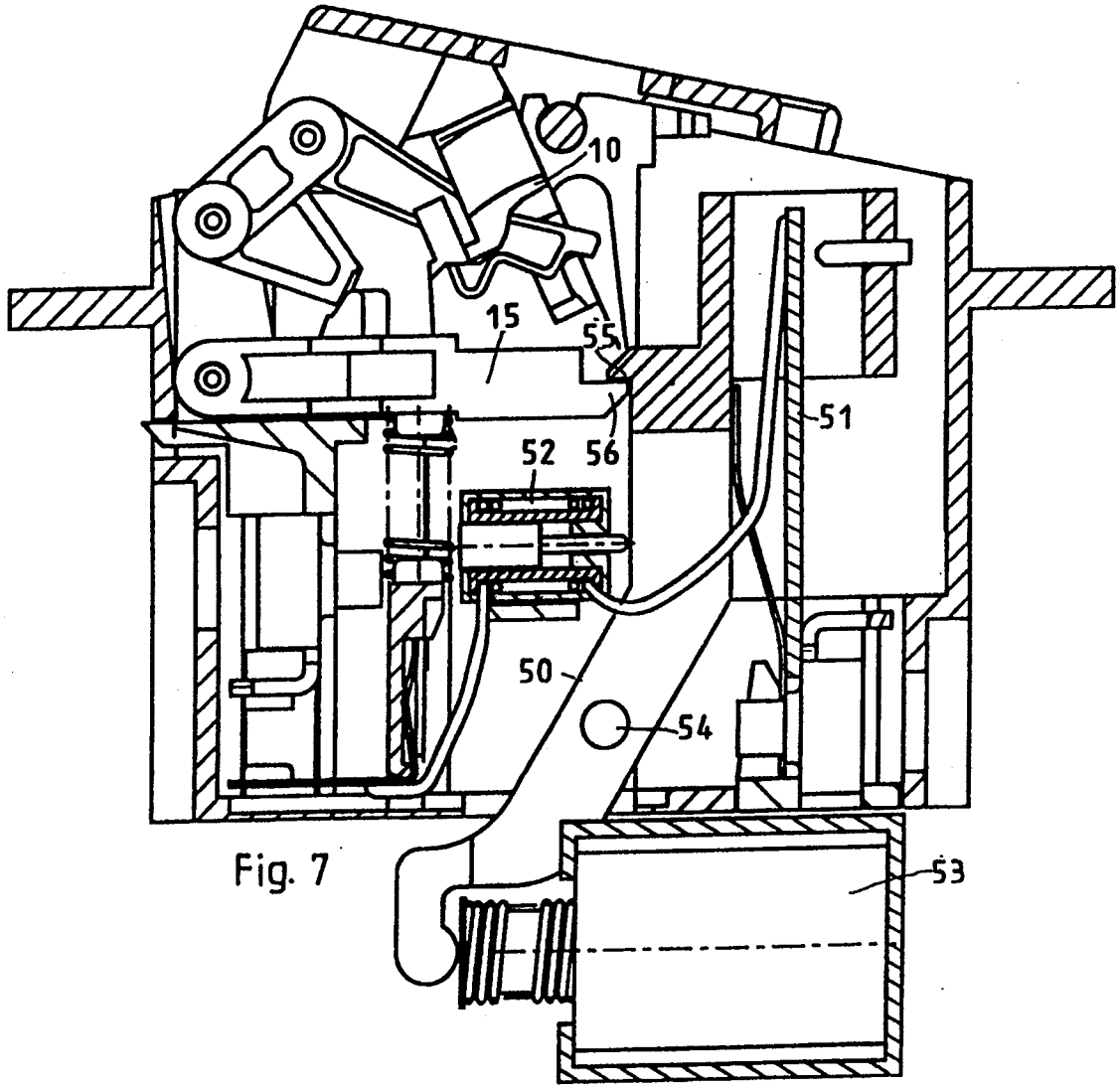
FIG. 7 shows a section through a modified embodiment.

FIG. 7 shows an embodiment with a lever-like latching piece 50 which is pivotal about an axis 54. A latching lug 55 cooperates with a lug 56 of the yoke lever 15. This switch therefore has a mechanical latching means.

Triggering of the latching piece 50 can be effected thermally by means of a bimetallic triggering element 51, in other words by means of overcurrent. Alternatively, a magnetic rapid triggering element 52 or an undervoltage triggering element 53 can be provided. Otherwise the switching function corresponds to the embodiment described above.

We claim the following:

1. An electrical switch with current monitoring capabilities, comprising:

a housing;

a slide bearing a plurality of contacts for a multi-pole circuit;

a bearing being fixed to said housing;

a pivot lever engaging said slide;

a first lever being coupled to said bearing;

a second lever being constructed as a latching lever for said pivot lever, said latching lever being active in a position with said toggle lever above dead center wherein said pivot lever engages said slide;

a transmission linkage constructed as a toggle lever having a toggle joint, said toggle joint connecting said first and said second lever;

a rocker for actuating said transmission linkage and coupled to said toggle joint, with said first lever being coupled to said toggle joint to which is coupled said bearing;

a pressure spring;

a latching piece; and, a yoke lever being constructed as a triggering lever for said second lever of said toggle lever, said yoke lever being a counterbearing for said pressure spring, wherein said latching piece latches said yoke lever and said pressure spring pre-tensions said slide and said pivot lever coupled thereto in a switched-"off" position, said pressure spring also supplying a tensioning force for said yoke lever for triggering said electrical switch.

2. The electrical switch according to claim 1, wherein said yoke lever comprises an armature for an electromagnet.

3. The electrical switch according to claim 1, wherein said latching piece is a pivotal latching piece which cooperates with a thermal bimetallic triggering element.

4. The electrical switch according to claim 1, wherein said latching piece is a pivotal latching piece which cooperates with a magnetic rapid triggering element.

5. The electrical switch according to claim 1, wherein said latching piece is a pivotal latching piece which cooperates with an undervoltage triggering element.

6. The electrical switch according to claim 1, wherein said pivot lever includes two arms between which said yoke lever and said second lever.

7. The electrical switch according to claim 1, wherein said first lever includes a profiled attachment piece in engagement with a profiled attachment piece of said yoke lever.

8. The electrical switch according to claim 7, wherein said profiled attachment piece has a circular profiled section and a cam.

9. The electrical switch according to claim 1, wherein said pivot lever bears a contact bridge having limited movability and cooperates with contacts of a conductor plate.

10. The electrical switch according to claim 1, wherein said yoke lever cooperates with an attachment of the second lever of the toggle joint.

* * * * *